US006033282A

United States Patent [19]

Lin

[11] Patent Number: 6,033,282

[45] Date of Patent: Mar. 7, 2000

[54] MULTIPURPOSE BUILT-UP MEASURING DEVICE

[75] Inventor: Fu-chi Lin, Taipei Hsien, Taiwan

[73] Assignee: Youth Toy Enterprise Co., Ltd., Taiepi Hsien, Taiwan

[21] Appl. No.: 09/244,685

[22] Filed: Feb. 4, 1999

[51] Int. Cl.[7] ..... A63H 33/08

[52] U.S. Cl. ..... 446/124; 446/125; 446/128; 434/187

[58] Field of Search ..... 434/187; 446/124, 446/125, 126, 127, 128

[56] References Cited

U.S. PATENT DOCUMENTS

| | | | |
|---|---|---|---|
| 2,911,818 | 11/1959 | Smith | 52/592.3 |
| 4,895,548 | 1/1990 | Holland et al. | 446/476 |
| 4,992,069 | 2/1991 | Bolli et al. | 446/128 |

FOREIGN PATENT DOCUMENTS

WO93/08886 5/1993 European Pat. Off. .

WO97/10036 3/1997 European Pat. Off. .

*Primary Examiner*—Robert A. Hafer
*Assistant Examiner*—Bena B. Miller
*Attorney, Agent, or Firm*—Pro-Techtor International Services

[57] ABSTRACT

Different types of measuring devices detachably built up with different elements are provided. The elements for forming the built-up measuring devices include suitable numbers of connecting rule elements, corner elements, swing elements, fixing bars, and fixing sleeves. The measuring devices that may be built up with the elements include but not limit to ruler, square, three-dimensional square, and arithmetic balance. These measuring devices integrate functions of many commercially available intellectual aids and can be used to take linear, area and cubic measures, practice four fundamental operations, and learn concepts about coordinates.

7 Claims, 12 Drawing Sheets

MULTIPURPOSE BUILT-UP MEASURING DEVICE

BACKGROUND OF THE INVENTION

The present invention relates to a multipurpose measuring device, and more particularly to a multipurpose measuring device that can be differently assembled from more than one type of elements depending on the functions to be achieved through the measuring device.

There are various kinds of intellectual and/or educational aids for children and even adults commercially available in the markets, such as puzzles, toy blocks, balances, checked boards, dimensional cubes, etc. Most of these intellectual and educational aids are designed to have only one single function. To help train children or adults to develop their intellect, it is frequently necessary to own different sets of intellectual aids that is, of course, troublesome and costly.

It is therefore desirable to develop a built-up intellectual aid that includes more than one type of commonly available intellectual aids, so that efforts and cost needed by consumers to select and purchase different intellectual aids can be effectively reduced.

SUMMARY OF THE INVENTION

A primary object of the present invention is to provide a multipurpose built-up measuring device that may have different forms and therefore different functions by integrating different elements to include more than one function that is provided by individual intellectual aids available in the markets while the cost thereof is largely reduced.

To achieve the above and other objects of the present invention, a group of different elements are provided to assemble into a multipurpose built-up measuring device. These elements mainly include suitable numbers of connecting rule elements, corner elements, fixing bars, fixing sleeves, and swing elements. Checked boards and dimensional cubes are selectively used with these elements to achieve the functions of the built-up measuring device of the present invention.

The connecting rule element each is a narrow, flat and long member and is provided along two longer edges with internally T-shaped sockets for receiving T-shaped connecting heads correspondingly provided along outer peripheries of the checked board. The connecting rule element includes two longitudinal rows of symmetrical and equally-spaced insertion holes on its top surface. Structurally complementary high and low connection ends are formed at two distal ends of the connecting rule element. The high connection end is provided at its bottom surface with a central projection and two longitudinally extended parallel ribs at two outer sides of the projection to correspond to a central through hole and two grooves, respectively, provided on a top surface of the low connection end. Whereby a long ruler may be provided by integrating two connecting rule elements by engaging the high connection end of one connecting rule element with the low connection end of the other connecting rule element.

The corner element each includes a squared flat board having a thickness the same as that of the connecting rule element, an island extended along a diagonal of a top surface thereof, and two connecting wings extended outward from two adjacent edges of the squared flat board at two sides of the island. The connecting wing is structurally identical to the low connection end of the connecting rule element. The island is provided along a center line thereof with a narrow insertion slot for a connecting rule element to vertically insert therein. Two groups of three recesses are symmetrically cut at two sides of the insertion slot for receiving the projection and the two parallel ribs of the connecting rule element vertically inserted in the insertion slot. Moreover, one group of three recesses have a larger depth for a lower end of the vertical connecting rule element to flush with a bottom surface of the corner element while the other group of three recesses have a smaller depth for a lower end of the vertical connecting rule element to flush with a top surface of the corner element. Two connecting rule elements and one corner element can be assembled to form a square. Three connecting rule elements and one corner element can be assembled to form a three-dimensional square.

The fixing bar each has a reduced insertion bar portion for fitly extending through a central through hole on the connecting wing of the corner element and inserting into an end of the fixing sleeve. The fixing sleeve each has a length slightly longer than a width of the connecting rule element. The swing element each includes a square board having two connecting portions formed at two opposite sides thereof. The connecting portion is structurally identical to the low connection end of the connecting rule element. Two wing-like covers are separately provided at another two opposite sides of the square board of the swing element. A bottom surface of the cover defines an obtuse angle for the swing element to seat on a corner of the corner element in an erected position to swing relative to the corner element. Two connecting rule elements, two corner elements, a swing element, two fixing sleeves, and two pairs of fixing bars may be assembled to form an arithmetic balance.

BRIEF DESCRIPTION OF THE DRAWINGS

The above and other objects of the present invention and the features and functions thereof can be best understood by referring to the following detailed description of the preferred embodiments and the accompanying drawings, wherein.

DETAILED DESCRIPTION OF THE PREFERRED EMBODIMENTS

Figure 1:
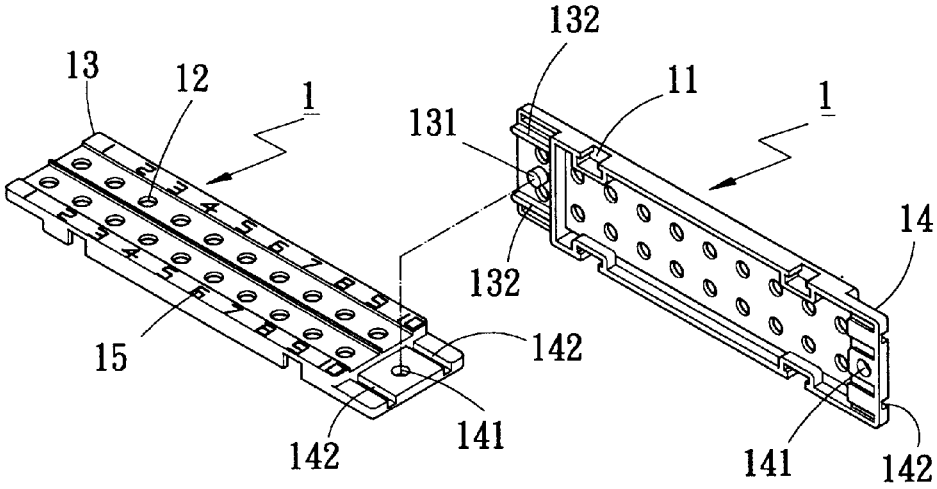
FIG. 1 is a perspective showing two connecting rule elements for forming a built-up ruler according to the present invention.

The present invention provides a multipurpose built-up measuring device that may be presented in different forms by assembling different elements together depending on different functions to be achieved by the measuring device. The elements for forming the built-up measuring device of the present invention mainly include suitable numbers of connecting rule elements 1, corner elements 2, fixing bars 3, fixing sleeves 4, and swing elements 5. Suitable numbers of 1 $cm^3$ cubes 6 and checked boards 7 commercially available in the intellectual aids markets can be selectively used with the elements of the present invention to form the built-up measuring device.

FIG. 1 illustrates two connecting rule elements 1 separated from each other to show top and bottom structures thereof. The connecting rule element 1 each is a narrow, flat and long member. Two longer edges of the connecting rule element 1 are symmetrically provided with internally T-shaped sockets 11 for receiving T-shaped connecting heads 71 (see FIG. 8B) correspondingly provided along outer peripheries of the checked board 7. The connecting rule element 1 includes two longitudinal rows of symmetrical and equally-spaced insertion holes 12. A suitable length of one of two distal ends of the connecting rule element 1 has a thickness being only one half of that of the connecting rule element 1 and locating at an upper half of the connecting rule element to form a high connection end 13. As the high connection end 13, the other distal end of the connecting rule element 1 also has a similar length with only one half thickness but locates at a lower half of the connecting rule element 1 and therefore forms a low connection end 14. The high connection end 13 is provided at its bottom surface with a central projection 131 and two longitudinally extended parallel ribs 132 at two outer sides of the projection 131. The low connection end 14 is provided at its top surface with a central through hole 141 in a size corresponding to the central projection 131 of the high connection end 13 and two longitudinally extended parallel grooves 142 corresponding to the two ribs 132. Scales 15 in the form of numerals are indicated on top surface of the connecting rule element 1 along two longitudinal edges thereof to separately correspond to the insertion holes 12 on the element 1. Numeral scales 15 are shown in forward sequence from the high connection end 13.

Figure 2A:
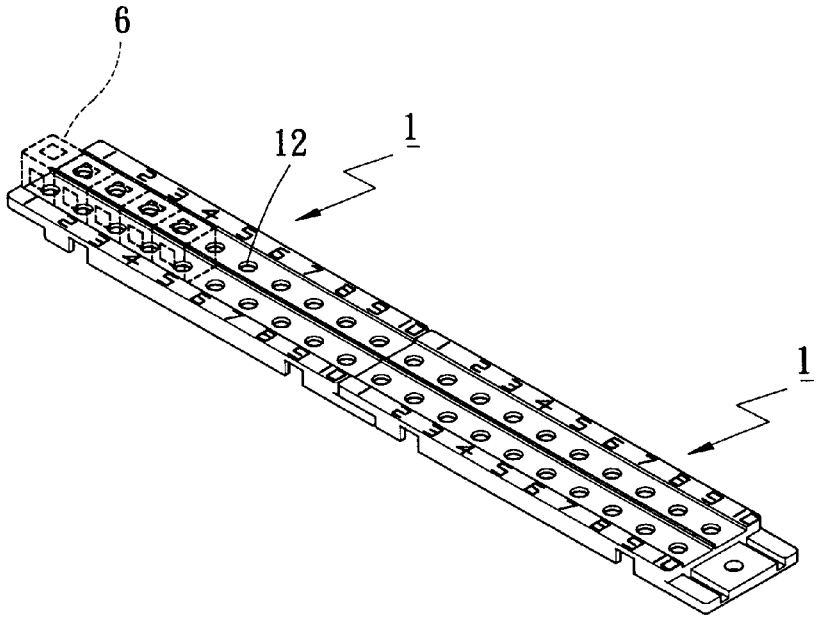
FIG. 2A is a perspective of a built-up ruler formed from the connecting rule elements of FIG. 1, wherein a row of 1 $cm^3$ cubes are measured with the ruler.
Figure 2B:
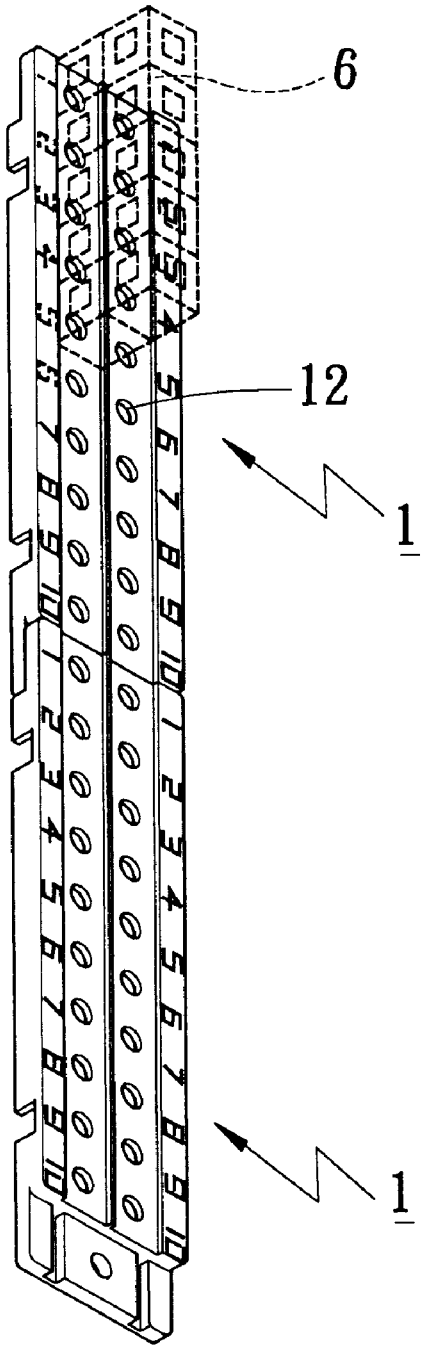
FIG. 2B is another perspective of the built-up ruler of FIG. 2, wherein two rows of 1 $cm^3$ cubes are measured with the ruler.

As shown in FIGS. 1, 2A and 2B, two connecting rule elements 1 can be connected together to produce a built-up long ruler by lapping the high connection end 13 of one connecting rule element 1 over the low connection end 14 of the other connecting rule element 1. When the high connection end 13 is lapped over the low connection end 14, the bottom projection 131 and the two parallel ribs 132 engage into the through hole 141 and the two grooves 142, respectively, and thereby firmly hold the two connecting rule elements 1 together in a straight line. Such a built-up long ruler may be used to take linear measures. Moreover, multiple pieces of 1 $cm^3$ cubes 6 can be inserted into insertion holes 12 on the top surface of the built-up long ruler for the purpose of calculating a certain volume or area represented by the cubes 6 and/or practicing four fundamental operations: addition, subtraction, multiplication, and division. Since the insertion holes 12 are designed for the 1 $cm^3$ cubes 6 to firmly insert thereinto, the built-up long ruler may be vertically positioned as shown in FIG. 2B without causing the cubes 6 to separate from the insertion holes 12.

Figure 3:
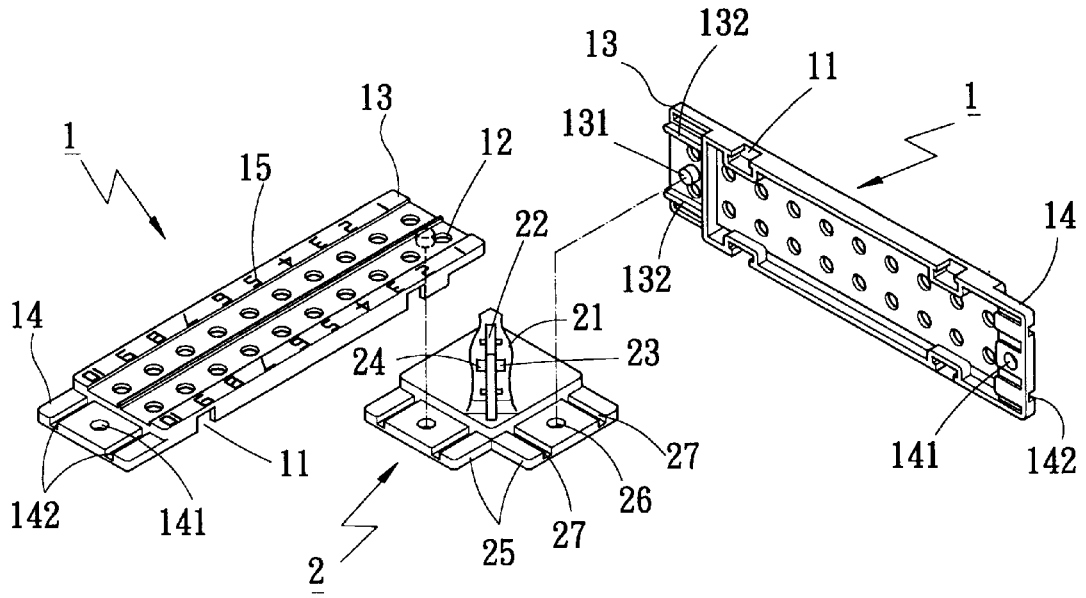
FIG. 3 is an exploded perspective of a built-up square formed from two connecting rule elements and a corner element according to the present invention.
Figure 4:
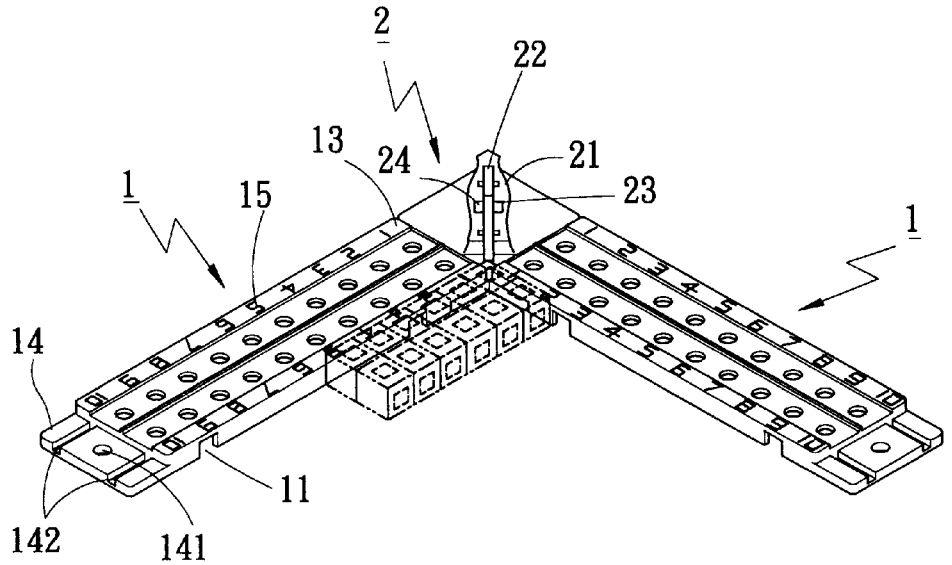
FIG. 4 is an assembled perspective of the built-up square of FIG. 3, wherein multiple 1 $cm^3$ cubes are measured with the built-up square.

Please refer to FIGS. 3 and 4 that are exploded and assembled perspectives, respectively, of a built-up square produced by assembling two connecting rule elements 1 and one corner element 2 of the present invention.

The corner element 2 includes a squared flat board having a thickness the same as that of the connecting rule element 1, an island 21 upward projected from and extended along a diagonal of a top surface of the corner element 2, and two connecting wings 25 extended outward from two adjacent edges of the squared flat board at two sides of the island 21. The connecting wing 25 has a structure identical to that of the low connection end 14 of the connecting rule element 1. That is, the connecting wing 25 has a thickness equal to only one half of that of the corner element 2 while the corner element 2 is the same thick as the connecting rule element 1, and has a central through hole 26 and two parallel grooves 27 provided thereon corresponding to the bottom projection 131 and the ribs 132 of the high connection end 13 on the connecting rule element 1. The island 21 is provided along a center line thereof with a narrow insertion slot 22 having a length corresponding to a width of the high connection end 13. Two groups of three recesses 23 and 24 are symmetrically cut at two sides of the narrow insertion slot 22. Two outer ones of the three recesses in each group 23, 24 have positions and profiles corresponding to a cross section of the two parallel ribs 132 while the middle recess corresponding to a diameter of the central projection 131. Moreover, the three recesses in the group 23 have a depth smaller than that of the three recesses in another group 24. Whereby when a connecting rule element 1 is vertically connected to the corner element 2 by inserting its high connection end 13 into the narrow insertion slot 22 with the ribs 132 and the projection 131 located in the three recesses of the group 23, a lower edge of the high connection end 13 is flush with the top surface of the corner element 2, and when the connecting rule element 1 is vertically connected to the corner element 2 with its high connection end 13 inserted into the narrow insertion slot 22 and the three recesses of the group 24, an lower edge of the high connection end 13 is flush with a bottom surface of the corner element 2.

The built-up square shown in FIGS. 3 and 4 is assembled from two connecting rule elements 1 and one corner element 2 by separately engaging the high connection ends 13 of the two connecting rule elements 1 with the two connecting wings 25 of the corner element 2, so that the bottom projection 131 and ribs 132 of the high connection ends 13 are firmly set in the central through holes 26 and the parallel grooves 27, respectively, of the connecting wings 25 to firmly hold the three elements together in a form of a right angle. The built-up square may be used not only to measure length and width of an article and an area thereof but also to practice the four fundamental operations and learn a basic concept about coordinates.

Figure 5:
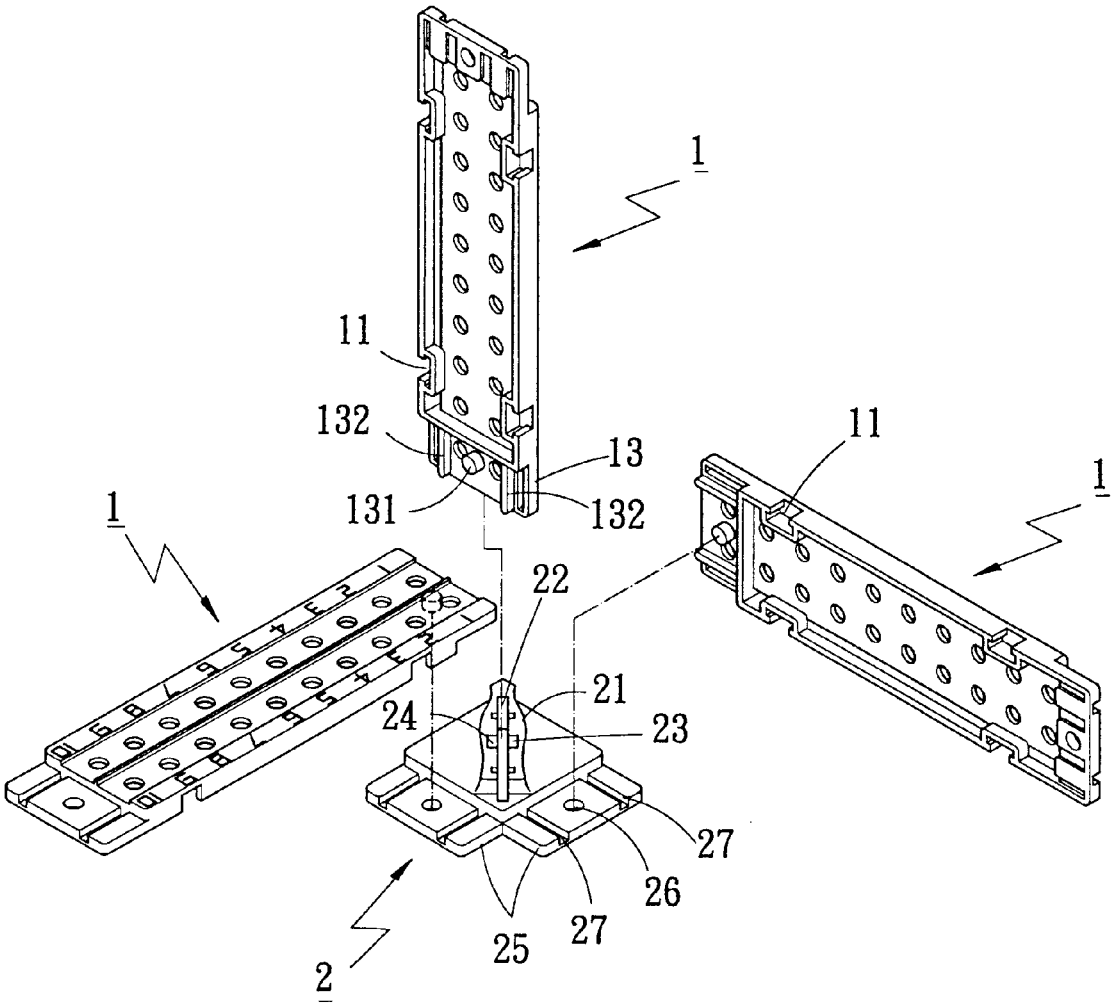
FIG. 5 is an exploded perspective of a three-dimensional square formed from three connecting rule elements and a corner element of the present invention.
Figure 6:
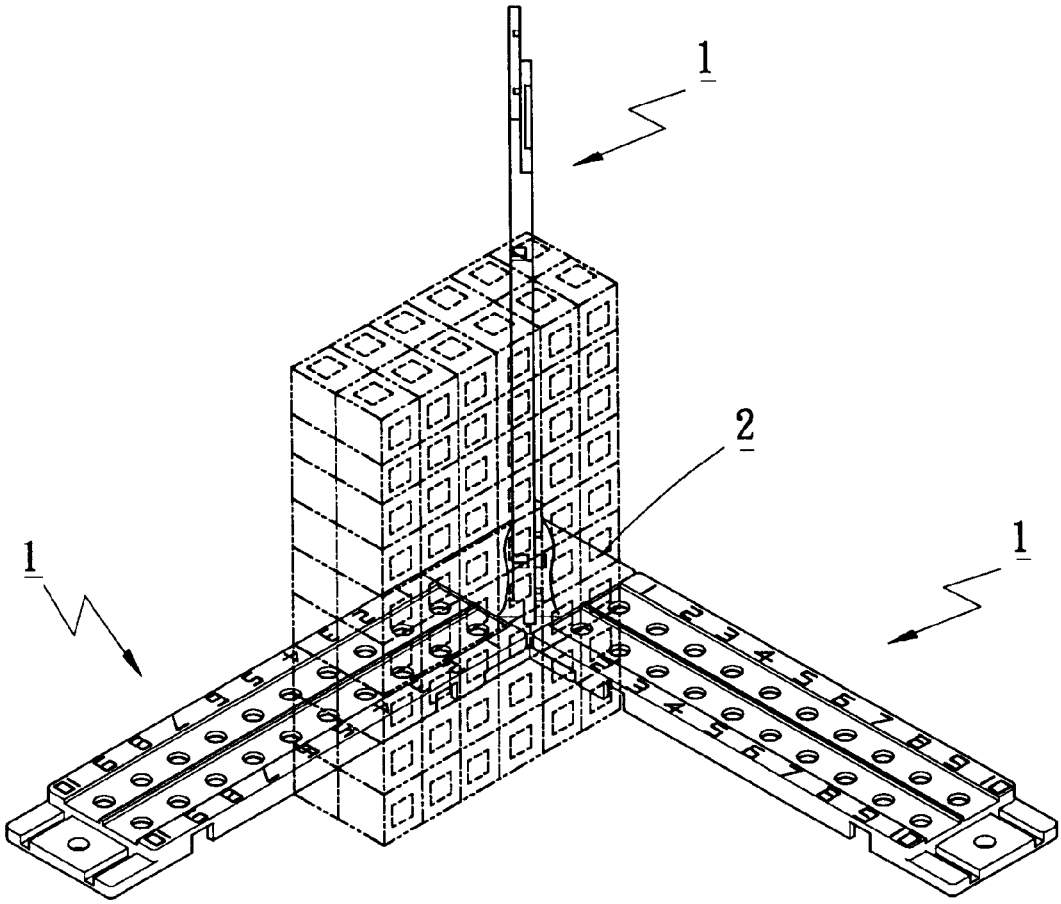
FIG. 6 is an assembled perspective of the three-dimensional square of FIG. 5, wherein multiple layers of 1 $cm^3$ cubes are measured with the three-dimensional built-up square.
Figure 7:
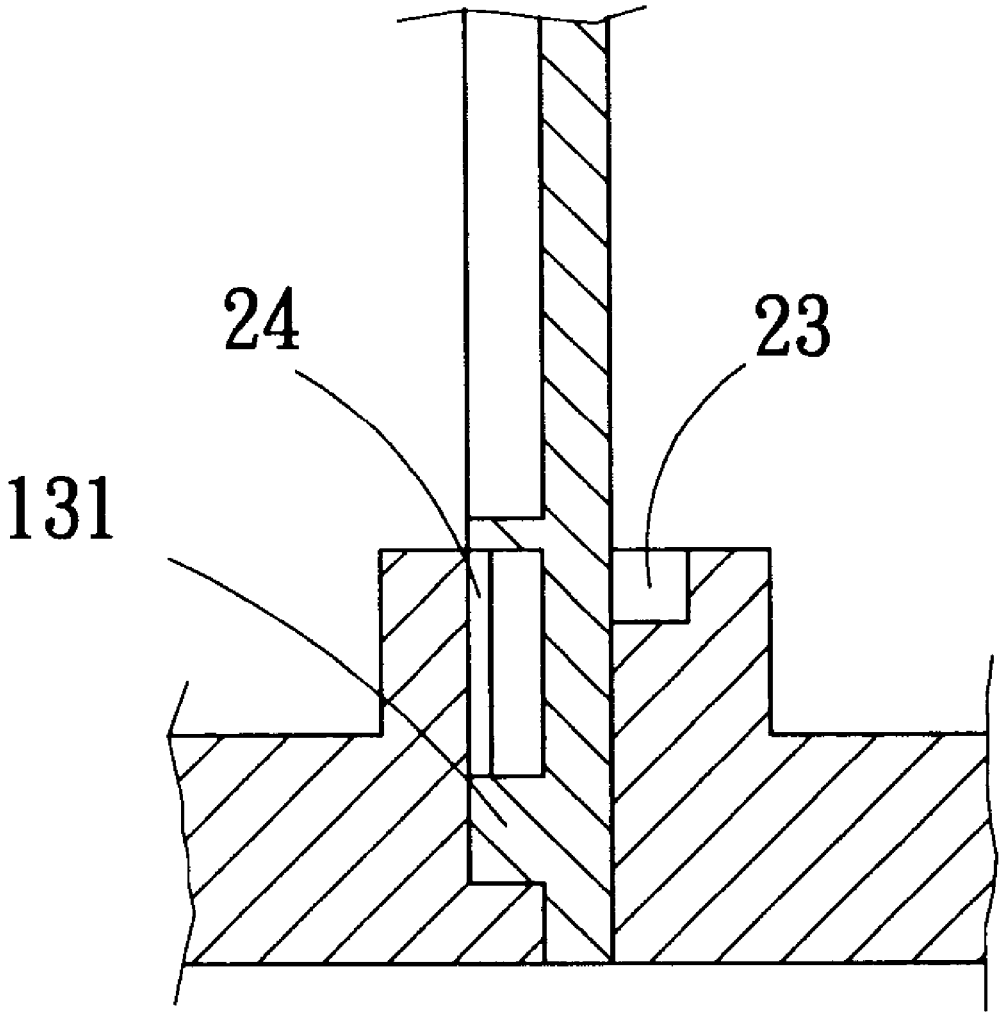
FIG. 7 is a fragmentary and enlarged sectional view of FIG. 6, showing the manner in which a vertical connecting rule element of the three-dimensional square is connected to the corner element thereof.

FIGS. 5 and 6 show exploded and assembled perspectives, respectively, of a three-dimensional square assembled from three connecting rule elements 1 and one corner element 2 of the present invention. Two of the three connecting rule elements 1 are horizontally connected at their high connection ends 13 to the two connecting wings 25 of the corner element 2 while the third connecting rule element 1 is vertically connected to the island 21 on the corner element 2 by inserting its high connection end 13 into the insertion slot 22. The manner in which the first two connecting rule elements 1 are connected to the connecting wings 25 has been described earlier in reference with FIGS. 3 and 4 and is therefore not repeated herein. In the three-dimensional square shown in FIGS. 5 and 6, the third connecting rule element 1 is vertically inserted into the insertion slot 22 with the bottom projection 131 and the ribs 132 located in the three recesses of the deep group 24, so that a lowest end of the vertical connecting rule element 1 is flush with the bottom surface of the corner element 2, as shown in FIG. 7. Articles to be measured, such as multiple layers of 1 $cm^3$ cubes 6, may be stacked in an angular space defined among the three connecting rule elements 1 connected to the corner element 2 to take the measurements of length, width and height, as well as the corresponding volume thereof. The three-dimensional square may also be used to practice the four fundamental operations and to learn basic concepts about coordinates.

Figure 8A:
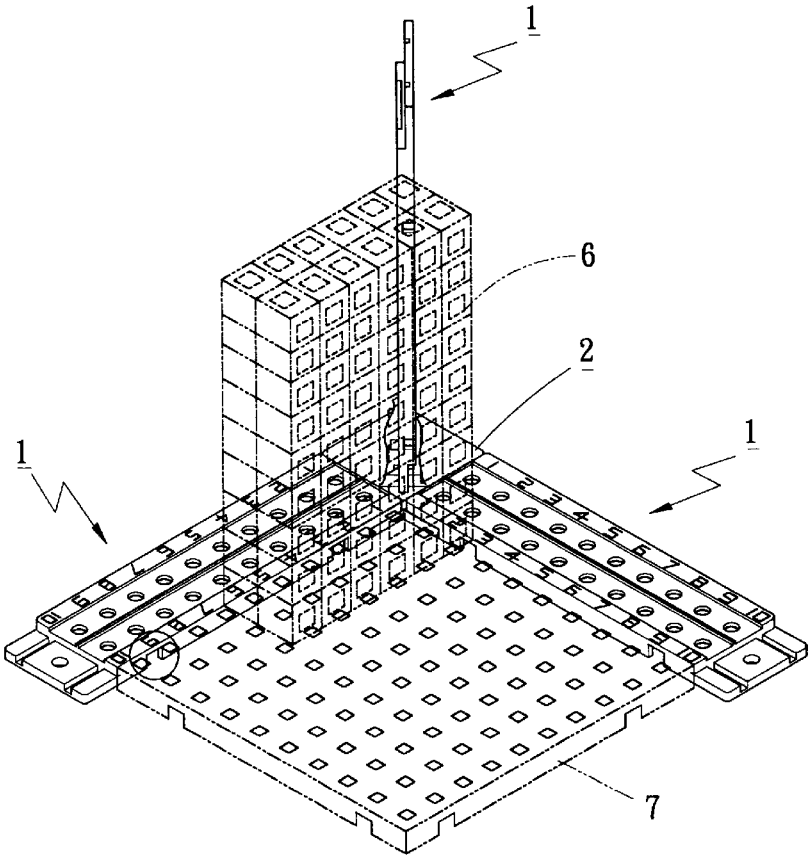
FIG. 8A is a perspective of an assembly of a three-dimensional square of the present invention and a checked board for measuring multiple layers of 1 $cm^3$ cubes.
Figure 8B:
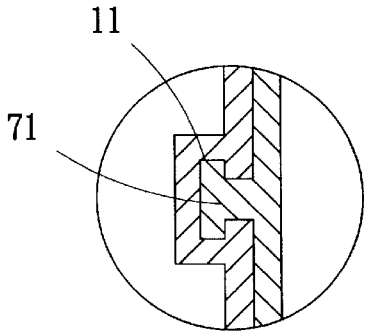
FIG. 8B is a fragmentary and enlarged sectional view showing the manner in which a horizontal connecting rule element of the three-dimensional square of FIG. 8A is connected to the checked board.
Figure 9:
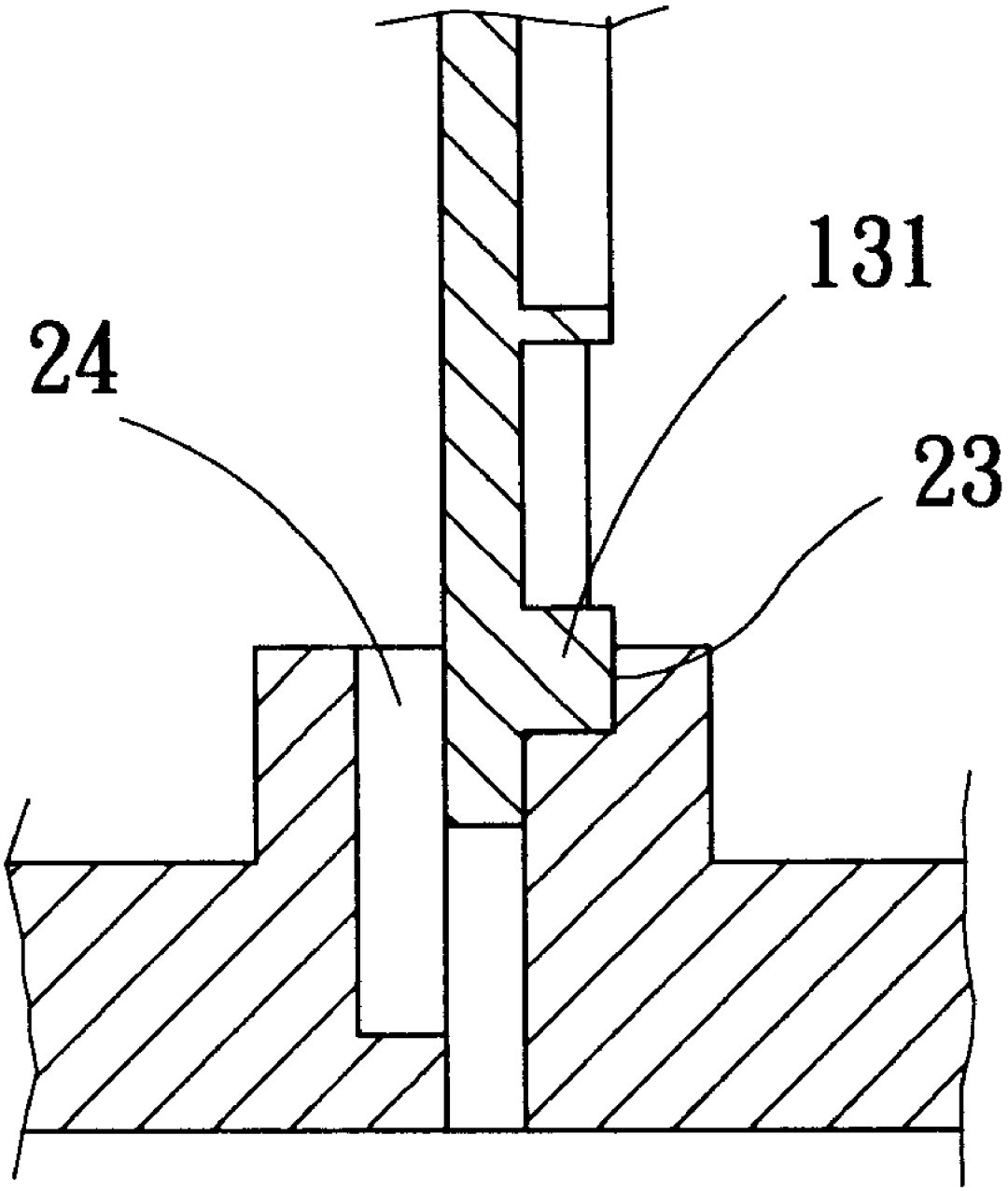
FIG. 9 is another fragmentary and enlarged sectional view showing the manner in which the vertical connecting rule element of the three-dimensional square of FIG. 8A is connected to the corner element.

A checked board 7 with equally-spaced dimensioned holes provided thereon may also be assembled with the above-described three-dimensional square, as shown in FIGS. 8A, 8B, and 9, to take measurements of a pile of 1 $cm^3$ cubes 6. The checked board 7 is connected to the two horizontal connecting rule elements 1 by engaging generally T-shaped connecting heads 71 provided along outer peripheries of the checked board 7 into the internally T-shaped sockets 11 of the connecting rule elements 1. FIG. 8B is a fragmentary and enlarged sectional view showing the connection of the connecting head 71 to the T-shaped socket 11. The 1 $cm^3$ cubes 6 are stacked on the checked board 7, so that a volume occupied by them can be measured with the three connecting rule elements 1 by measuring the total width, length and height of these stacked cubes 6. Since the checked board 7 has a thickness the same as that of the connecting rule elements 1, the cubes 6 or any other objected to be measured positioned on the board 7 are located at a plane flush with the top surfaces of the connecting rule elements 1 and of the corner element 2. To correctly take the measurements of height of the cubes 6 or the object to be measured, the vertical connecting rule element 1 should be inserted into the slot 22 and the three shallow recesses in the group 23 to allow the lower edge of the high connection end 13 of the vertical connecting rule element 1 to flush with the top surface of the corner element 2, as shown in FIG. 9.

Figure 10:
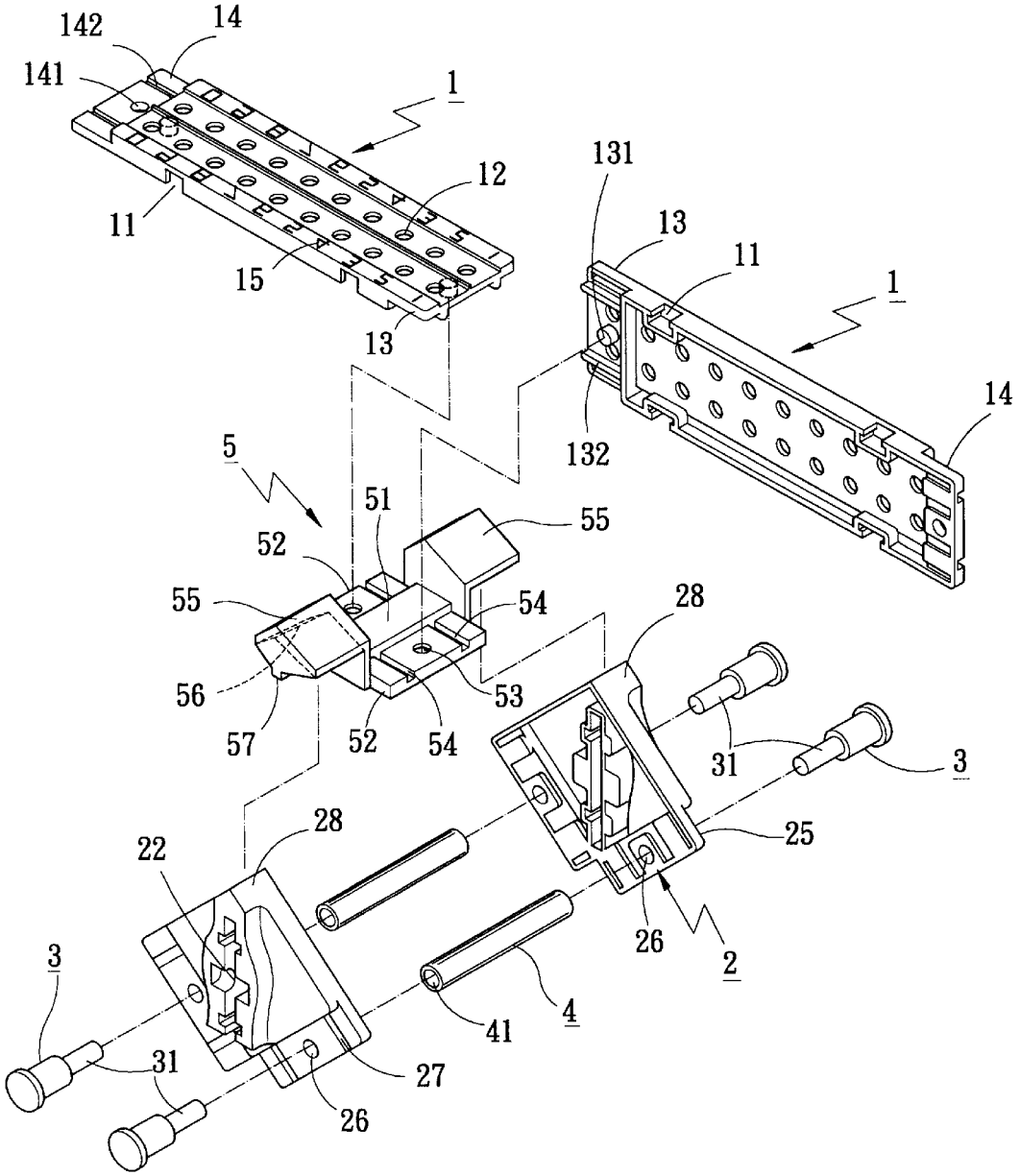
FIG. 10 is an exploded perspective of a built-up arithmetic balance according to the present invention.
Figure 11:
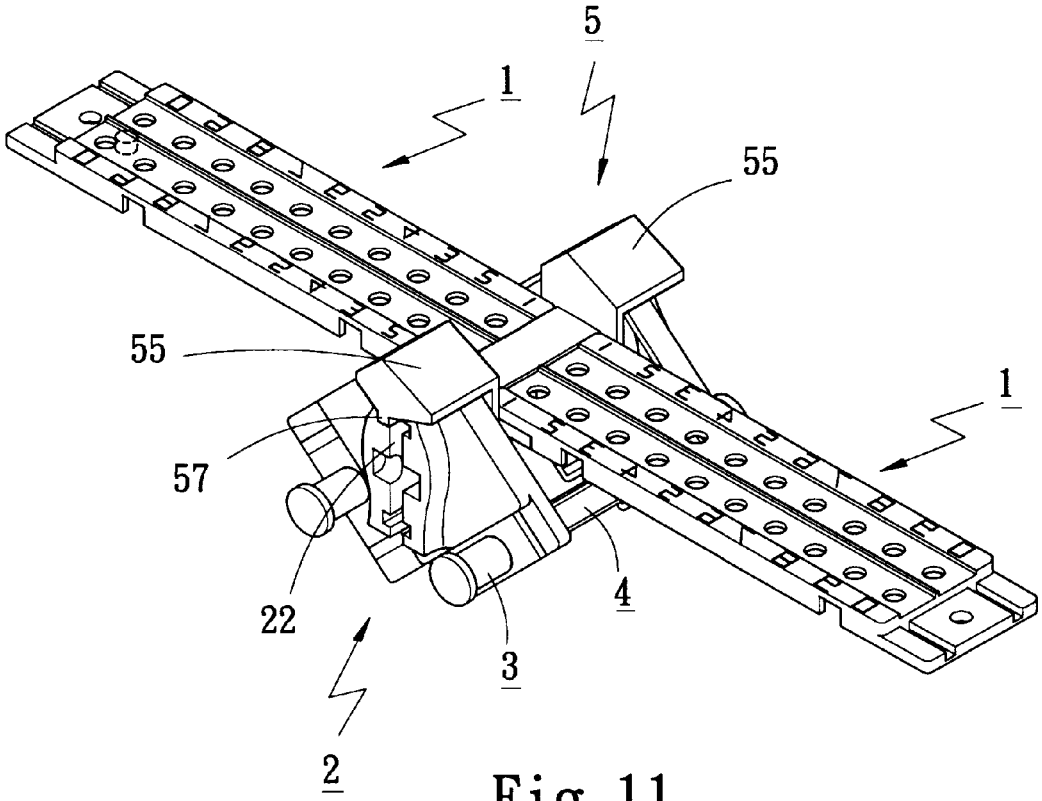
FIG. 11 is an assembled perspective of the arithmetic balance of FIG. 10.

FIGS. 10 and 11 are exploded and assembled perspectives, respectively, of a built-up arithmetic balance produced with at least two connecting rule elements 1, two corner elements 2, two pairs of fixing bars 3, two fixing sleeves 4, and a swing element 5 of the present invention.

The fixing bar 3 each includes a reduced insertion bar portion 31 having an outer diameter the same as an inner diameter of the central through hole 26 on the connecting wing 25 of the corner element 2. The fixing sleeve 4 each has an inner diameter 41 the same as the outer diameter of the insertion bar portion 31, so that the insertion bar portion 31 of the fixing bar 3 can be firmly inserted into and assembled to an outer end of the fixing sleeve 4. The fixing sleeve 4 each has a length slightly longer than a width of the connecting rule element 1. The swing element 5 includes a square board 51 having two connecting portions 52 formed at two opposite sides thereof. The connecting portion 52 each has a structure identical to that of the low connection end 14 of the connecting rule element 1. That is, the connecting portion 52 each is provided with a central through hole 53 and two grooves 54 corresponding to the bottom projection 131 and the parallel ribs 132, respectively, of the high connection end 13 of the connecting rule element 1. Two wing-like covers 55 separately extend upward and then outward from another two opposite sides of the square board 51 of the swing element 5. A bottom surface of the cover 55 defines an obtuse angle 56 so that the swing element 5 can be supported by an erected corner element 2 on a corner 28 far away from the two connecting wings 25 to swing relative to the corner element 2. A pointer 57 downward extends from a lower center of an outer edge of the cover 55.

Figure 12:
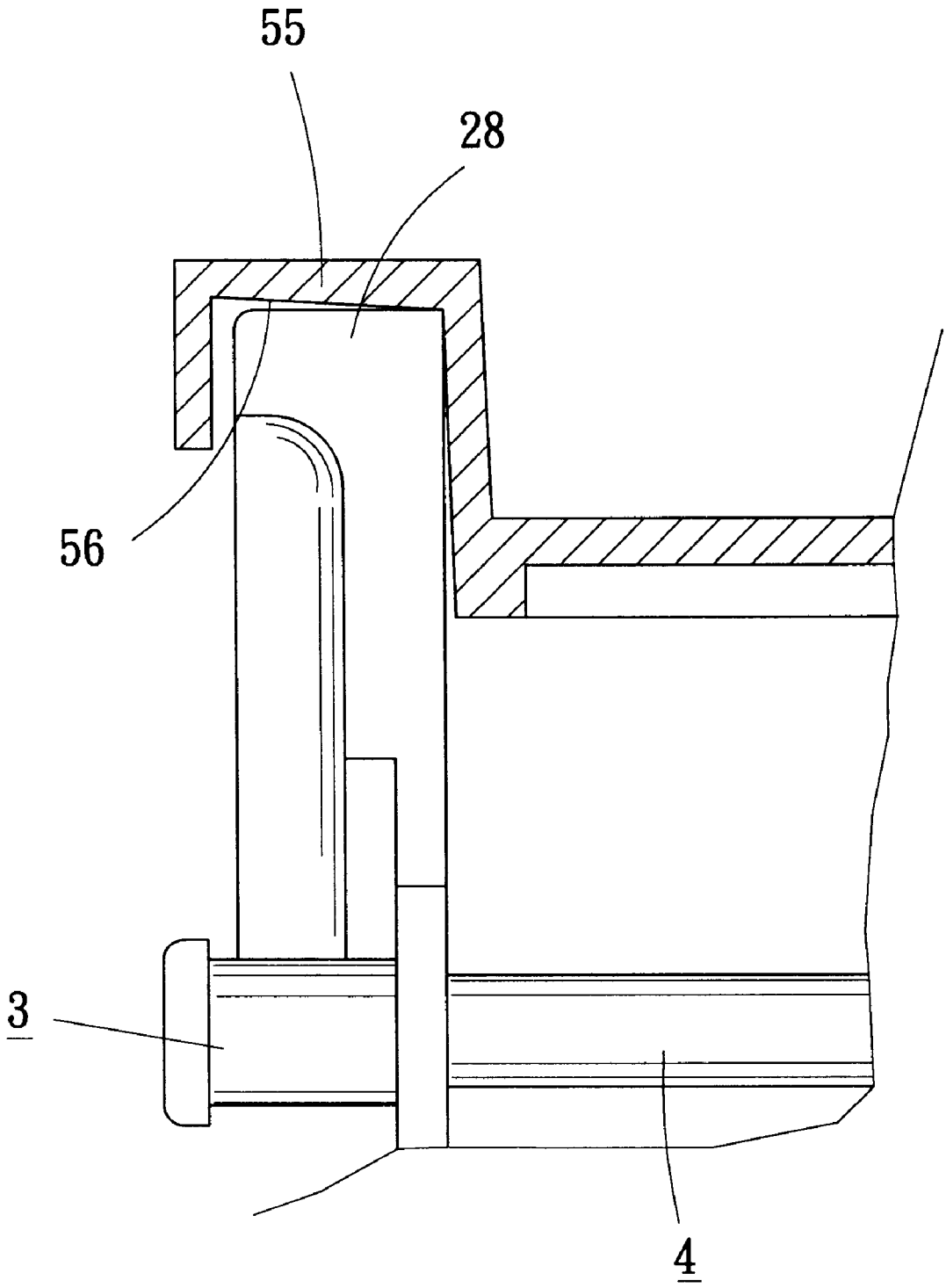
FIG. 12 is a fragmentary and enlarged sectional view of FIG. 11 showing the line contact relation between the corner element and the swing element thereof.

To form the arithmetic balance shown in FIG. 11, the two corner elements 2 are erected to form a support by separately extending the insertion bar portions 31 of the two pairs of fixing bars 3 inward to pass through the central through holes 26 on the connecting wings 25 of the corner elements 2 and into outer ends 41 of the two fixing sleeves 4 disposed between the two corner elements 2. The swing element 5 is then positioned to straddle the two erected corner elements 2 with the two covers 55 supported on the corners 28 that face upward. The two connecting rule elements 1 are then firmly connected at their high connection ends 13 to the two connecting portion 52 of the swing element 5 with the projections 131 and the ribs 132 engaging with the central through holes 53 and the grooves 54, respectively. Since the obtuse angle 56 defined by the cover 55 of the swing element 5 is larger than a right angle defined by the corner 28 of the corner element 2, the swing element 5 and the corner element 2 contact with one another at the cover 55 and the corner 28 in a relation of line contact, as shown in FIG. 12. Whereby, a friction between the swing element 5 and the corner element 2 is minimized to allow the swing element 5 to swing freely and smoothly.

Figure 13:
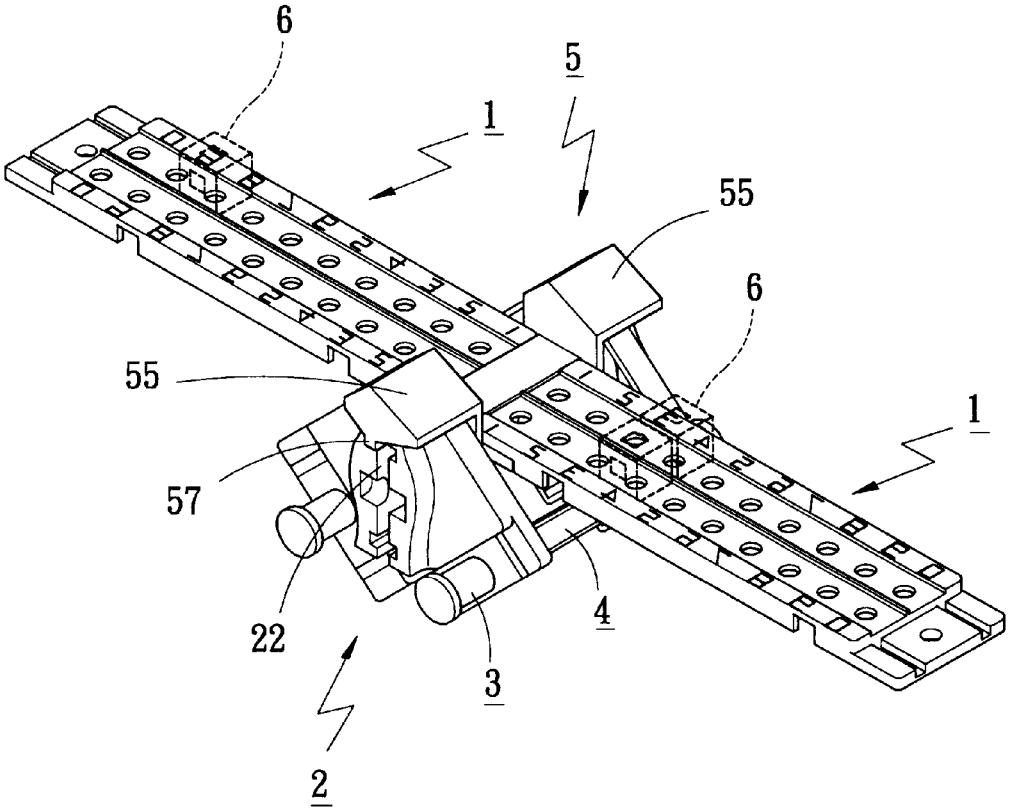
FIG. 13 shows the arithmetic balance of FIG. 11 is used to measure multiple pieces of 1 $cm^3$ cubes.

The pointer 57 provided at the lower center of the cover 55 of the swing element 5 serves as means for checking the balanced state of the arithmetic balance. When the pointers 57 are in alignment with the insertion slots 22 on the erected corner elements 2, the arithmetic balance is in a balanced position. Desired numbers of 1 $cm^3$ cubes 6 may be inserted into the insertion holes 12 on the connecting rule elements 1 of the arithmetic balance as shown in FIG. 13, in order to practice the four fundamental operations and to learn basic concepts about the lever principle, weight, etc.

With the above-described five different elements, that is, the connecting rule element 1, the corner element 2, the fixing bar 3, the fixing sleeve 4, and the swing element 5, more than one type of built-up measuring device can be produced to perform multiple functions, including but not limited to practicing four fundamental operations and taking linear, square, and cubic measures. The built-up measuring device provided by the present invention integrates different intellectual aids available in the markets and therefore reduces the costs otherwise needed by consumers to obtain such aids in separated forms.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A multipurpose built-up measuring device comprising:

a plurality of measuring elements detachably assembled, said measuring elements including suitable numbers of connecting rule elements, corner elements, fixing bars, fixing sleeves, and swing elements;

said connecting rule element each being a narrow, flat and long member and being provided along two longer edges thereof with internally T-shaped sockets for receiving T-shaped connecting heads correspondingly provided along outer peripheries of a checked board selectively connected to said connecting rule element, on a top surface with two longitudinal rows of symmetrical and equally-spaced insertion holes, and at two distal ends with structurally complementary high and low connection ends that have a thickness being only one half of that of said connecting rule element; and said high connection end being provided at a bottom surface with a downward extended central projection and two longitudinally extended parallel ribs at two outer sides of said projection to correspond to a central through hole and two grooves, respectively, provided on a top surface of said low connection end;

said corner element each including a squared flat board having a thickness the same as that of said connecting rule element, an island extending along a diagonal of a top surface of said squared flat board, and two connecting wings extended outward from two adjacent edges of said squared flat board at two sides of said island; said connecting wing being structurally identical to said low connection end of said connecting rule element, said island being provided along a center line thereof with a narrow insertion slot for one said connecting rule element to vertically insert therein, two groups of three recesses being symmetrically cut at two sides of said insertion slot for receiving said downward extended central projection and said two parallel ribs of said connecting rule element vertically inserted in said insertion slot; a first of said two groups of three recesses having a depth for a lower end of said connecting rule element to be flush with a bottom surface of said corner element and a second of said two groups of three recesses have a depth for a lower end of said connecting rule element to be flush with a top surface of said corner element;

said fixing bar each including a reduced insertion bar portion having an outer diameter the same as an inner diameter of a central through hole on said connecting wing of said corner element and as an inner diameter of said fixing sleeves and therefore being suitable for extending through said connecting wing of said corner element via said central through hole and into outer end of said fixing sleeve to assemble said corner element and said fixing sleeve together;

said fixing sleeve each having an inner diameter the same as the outer diameter of said insertion bar portion of said fixing bar and a length slightly longer than a width of said connecting rule element; and said swing element each including a square board having two connecting portions formed at two opposite sides thereof, said connecting portion each having a structure identical to that of said low connection end of said connecting rule, two wing-like covers separately extending upward and then outward from another two opposite sides of said square board of said swing element and defining an obtuse angle at a bottom surface thereof, so that said swing element can be supported by two spaced and erected corner elements on their corners far away from said two connecting wings to swing relative to said corners.

2. A multipurpose built-up measuring device comprising:

a plurality of measuring elements detachably assembled, said measuring elements including suitable numbers of connecting rule elements, corner elements, fixing bars, fixing sleeves, and swing elements;

said connecting rule element each being a narrow, flat and long member and being provided along two longer edges thereof with internally T-shaped sockets for receiving T-shaped connecting heads correspondingly provided along outer peripheries of a checked board selectively connected to said connecting rule element, on a top surface with two longitudinal rows of symmetrical and equally-spaced insertion holes, and at two distal ends with structurally complementary high and low connection ends that have a thickness being only one half of that of said connecting rule element; and said high connection end being provided at a bottom surface with a downward extended central projection and two longitudinal extended parallel ribs at two outer sides of said projection to correspond to a central through hole and two grooves, respectively, provided on a top surface of said low connection end;

each said corner element including a squared flat board having a thickness the same as that of said connecting rule element, an island extending along a diagonal of a top surface of said squared flat board, and two connecting wings extended outward from two adjacent edges of said squared flat board at two sides of said island; said connecting wings being structurally identical to said low connection end of said connecting rule element, said island being provided along a center line thereof with a narrow insertion slot for one said connecting rule element to vertically insert therein, two groups of three recesses being symmetrically cut at two sides of said insertion slot for receiving said downward extended central projection and said two parallel ribs of said connecting rule element vertically inserted in said insertion slot; a first of said two groups of three recesses having a depth for a lower end of said connecting rule element to be flush with a bottom surface of said corner element and a second of said two groups of three recesses have a depth for a lower end of said connecting rule element to be flush with a top surface of said corner element;

said fixing bar each including a reduced insertion bar portion having an outer diameter the same as an inner diameter of a central through hole on said connecting wing of said corner element and as an inner diameter of said fixing sleeves and therefore being suitable for extending through said connecting wing of said corner element via said central through hole and into outer end of said fixing sleeve to assemble said corner element and said fixing sleeve together;

said fixing sleeve each having an inner diameter the same as the outer diameter of said insertion bar portion of said fixing bar and a length slightly longer than a width of said connecting rule element;

said swing element each including a square board having two connecting portions formed at two opposite sides thereof, said connecting portion each having a structure identical to that of said low connection end of said connecting rule, two wing-like covers separately extending upward and then outward from another two opposite sides of said square board of said swing element and defining an obtuse angle at a bottom surface thereof, so that said swing element can be supported by two spaced and erected corner elements on their corners far away from said two connecting wings to swing relative to said corners; and wherein said built-up measuring device is a square comprising at least two said connecting rule elements and one of said corner elements by separately engaging said high connection ends of said two connecting rule elements with said two connecting wings of said one of said corner elements, so that said bottom projection and said ribs of said high connection ends are firmly set in central through holes and parallel grooves, respectively, of said connecting wings to firmly hold said three elements together in a form of a right angle.

3. The multipurpose built-up measuring device as claimed in claim 2, wherein:

said connecting rule element is provided on a top surface along two longitudinal edges thereof with scales in the form of numerals to separately correspond to said insertion holes on said connecting rule element, and said numerals of said scales are shown in forward sequence starting from said high connection end of said connecting rule element.

4. The multipurpose built-up measuring device as claimed in claim 2, wherein:

said cover of said swing element is provided at an outer lower center with a downward extended pointer.

5. A multipurpose built-up measuring device comprising:

a plurality of measuring elements detachably assembled, said measuring elements including suitable numbers of connecting rule elements, corner elements, fixing bars, fixing sleeves, and swing elements;

said connecting rule element each being a narrow, flat and long member and being provided along two longer edges thereof with internally T-shaped sockets for receiving T-shaped connecting heads correspondingly provided along outer peripheries of a checked board selectively connected to said connecting rule element, on a top surface with two longitudinal rows of symmetrical and equally-spaced insertion holes, and at two distal ends with structurally complementary high and low connection ends that have a thickness being only one half of that of said connecting rule element; and said high connection end being provided at a bottom surface with a downward extended central projection and two longitudinally extended parallel ribs at two outer sides of said projection to correspond to a central through hole and two grooves, respectively, provided on a top surface of said low connection end;

each said corner element including a squared flat board having a thickness the same as that of said connecting rule element, an island extending along a diagonal of a top surface of said squared flat board, and two connecting wings extended outward from two adjacent edges of said squared flat board at two sides of said island; said connecting wings being structurally identical to said low connection end of said connecting rule element, said island being provided along a center line thereof with a narrow insertion slot for one said connecting rule element to vertically insert therein, two groups of three recesses being symmetrically cut at two sides of said insertion slot for receiving said downward extended central projection and said two parallel ribs of said connecting rule element vertically inserted in said insertion slot; a first of said two groups of three recesses having a depth for a lower end of said connecting rule element to be flush with a bottom surface of said corner element and a second of said two groups of three recesses have a depth for a lower end of said connecting rule element to be flush with a top surface of said corner element;

said fixing bar each including a reduced insertion bar portion having an outer diameter the same as an inner diameter of a central through hole on said connecting wing of said corner element and as an inner diameter of said fixing sleeves and therefore being suitable for extending through said connecting wing of said corner element via said central through hole and into outer end of said fixing sleeve to assemble said corner element and said fixing sleeve together;

said fixing sleeve each having an inner diameter the same as the outer diameter of said insertion bar portion of said fixing bar and a length slightly longer than a width of said connecting rule element;

said swing element each including a square board having two connecting portions formed at two opposite sides thereof, said connecting portion each having a structure identical to that of said low connection end of said connecting rule, two wing-like covers separately extending upward and then outward from another two opposite sides of said square board of said swing element and defining an obtuse angle at a bottom surface thereof, so that said swing element can be supported by two spaced and erected corner elements on their corners far away from said two connecting wings to swing relative to said corners; and wherein said built-up measuring device is an arithmetic balance comprising at least two said connecting rule elements, two said corner elements, one said swing element, two said fixing sleeves, and two pairs of said fixing bars by erecting said two corner elements with their top surfaces having said islands facing outward and two sides having said connecting wings facing downward, separately extending said insertion bar portions of said two pairs of fixing bars inward to pass through said central though holes on said connecting wings of said two corner elements and into outer ends of said two fixing sleeves disposed between said two corner elements, positioning said swing element to straddle said two erected corner elements with said covers of said swing elements supported on corners of said corner elements that face upward, and connecting said at least two connecting rule elements at their high connection ends to said two connecting portions of said swing element.

6. The multipurpose built-up measuring device as claimed in claim 5, wherein:

said connecting rule element is provided on a top surface along two longitudinal edges thereof with scales in the form of numerals to separately correspond to said insertion holes on said connecting rule element, and said numerals of said scales are shown in forward sequence starting from said high connection end of said connecting rule element.

7. The multipurpose built-up measuring device as claimed in claim 5, wherein:

said cover of said swing element is provided at an outer lower center with a downward extended pointer.

* * * * *